United States Patent [19]

Klusmier

[11] Patent Number: 4,693,736

[45] Date of Patent: Sep. 15, 1987

[54] OIL COOLED HERMETIC COMPRESSOR USED FOR HELIUM SERVICE

[75] Inventor: Lawrence A. Klusmier, Chelmsford, Mass.

[73] Assignee: Helix Technology Corporation, Waltham, Mass.

[21] Appl. No.: 906,797

[22] Filed: Sep. 12, 1986

[51] Int. Cl.[4] ..... F25B 9/00

[52] U.S. Cl. ..... 62/6; 62/84; 62/468

[58] Field of Search ..... 417/228; 62/468, 469, 62/470, 506, 84, 6

[56] References Cited

U.S. PATENT DOCUMENTS 2,963,886 12/1960 Palmatier ..... 62/468

4,419,865 12/1983 Szymaszek .

4,516,916 5/1985 English et al. .

4,558,573 12/1985 La Monica ..... 62/84 X

*Primary Examiner*—Henry A. Bennet

*Attorney, Agent, or Firm*—Hamilton, Brook, Smith & Reynolds

[57] ABSTRACT

In a cryogenic refrigeration system, a hermetic refrigerant compressor pump is used to compress helium. The compressor pump 10 is oil cooled by a heat exchange jacket 46 surrounding a compressor housing 28. Oil from an oil sump 30 within the compressor housing 28 is pumped through an external heat exchanger 44 where it is cooled, to the heat exchange jacket 46. From the heat exchange jacket 46, oil is recycled back to the oil sump 30. Pressure developed by the compressor pump 10 is used to pump the oil.

20 Claims, 2 Drawing Figures

OIL COOLED HERMETIC COMPRESSOR USED FOR HELIUM SERVICE

BACKGROUND

This invention pertains generally to the cooling of a hermetic compressor pump used in cryogenic refrigeration. Typically, this pump compresses a mixture of oil and helium. The purpose of the oil is to absorb the heat produced in compressing helium and to provide lubrication to the pump. From the compressor, the mixture exits a feed line in which the oil is separated from the mixture. Conventional methods use an oil separator and then an oil adsorber to filter the oil out of the mixture. Once separated, the gas is then pumped to the cold head of a cryogenic refrigerator such as a Gifford-MacMahon cryogenic refrigerator disclosed in U.S. Pat. No. 3,218,815 to Chellis et al. After traveling through the refrigerator, the gas is returned through a return line to start the process over again.

As a result of compressing helium, rather than freon which is used in other refrigeration systems, more heat is produced by the compressor pump. In order to maintain operating efficiency, this heat by-product must be removed.

Presently, there are three traditional methods for removing the heat created by compressing helium. In one, a water jacket is attached to the housing of the pump. This is generally the most common type of conduction cooling. This method, however, requires a seperate water supply and a seperate pump. In another method, convection fins are placed on the pump's housing. A fan is then placed above or below the pump for air cooling. Such arrangements, however, require an appreciable amount of space. In a third method, a desuper-heat pump cools the compressed gas leaving the pump and re-enters the pump to cool the motor windings before leaving the pump to do work. In this method the working gas is heated. Therefore, there exists a need to develop a cooling system which will cool the pump efficiently while achieving a smaller packaging size.

DISCLOSURE OF THE INVENTION

In accordance with the invention, a hermetic refrigerant compressor pump which is used to compress helium is oil cooled. To cool the compressor, oil from a sump located within the pump is cooled by a first external heat exchanger. From the first exchanger, cooled oil is pumped into a heat exchange jacket surrounding the pump. Heat from the pump is absorbed by the oil in the jacket and is passed through a second external heat exchanger for a second cooling. From the second exchanger, oil is mixed with helium for compression.

Preferably, there is a means for separating oil from the compressed helium before it is used in a cryogenic refrigeration system.

BRIEF DESCRIPTION OF THE DRAWINGS

The foregoing and other objects, features and advantages of the invention will be apparent from the following more particular description of a preferred embodiment of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

Figure 1:
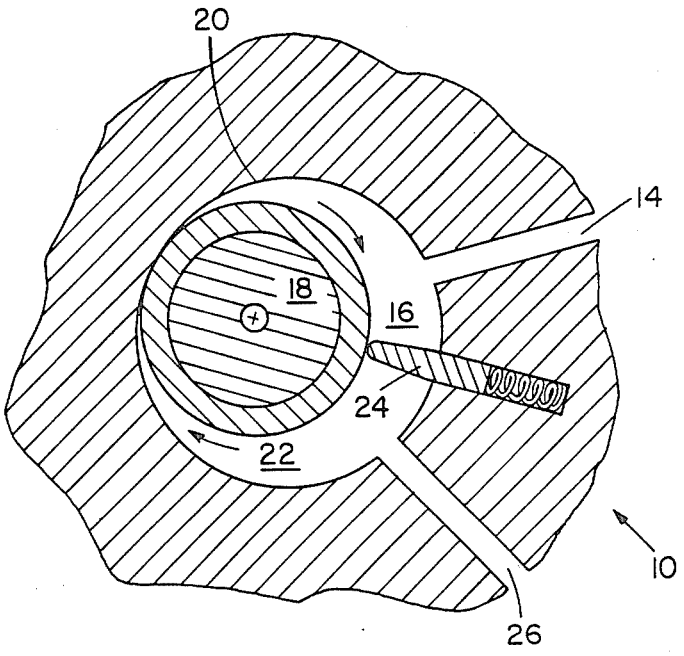
FIG. 1 is an illustration of a partial cross section of a compressor pump.

The present invention relates to a cryogenic refrigeration system which has a compressor pump cooled by an oil heat exchange jacket 46. A partial cross section of a typical compressor pump 10 is shown in FIG. 1. The compressor pump 10 draws a helium gas and oil mixture through an inlet port 14 to a suction chamber 16 which is created as a rolling piston 18 rotates around a cylinder 20. The mixture is then compressed in a compression chamber 22 as the piston 18 makes a complete revolution around the cylinder 20. Simultaneously, more of the mixture is drawn into the suction chamber 16. A vane 24 which is biased to remain in contact with the rolling piston 18 defines the suction chamber 16 and the compression chamber 22. The compressed mixture is exhausted out an exhaust port 26.

Figure 2:
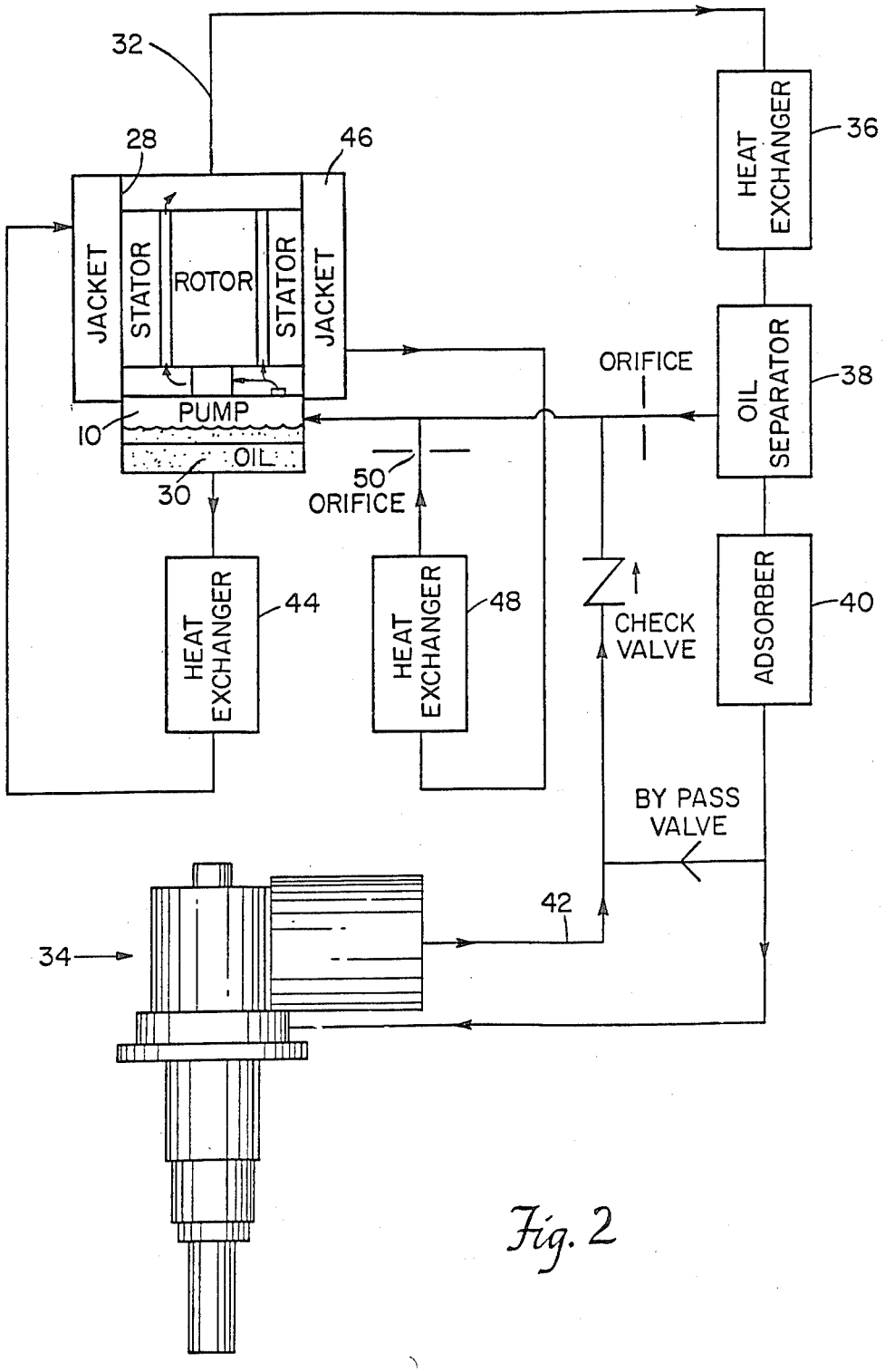
FIG. 2 is a schematic illustration of a compressor system embodying the invention.

The compressor pump 10 is located within a compressor housing 28, as shown in FIG. 2. As the compressed mixture is exhausted from the pump 10 into the housing, the bulk of the oil separates from the compressed gas and collects at a sump 30. The compressed gas is then fed into a feed line 32 for work. To further prepare the compressed gas for work in a cryogenic refrigerator 34 such as a Gifford-MacMahon cryogenic refrigerator, it is preferred that the gas is cooled by a heat exchanger 36 and further filtered from an oil by an oil seperator 38 and an absorber 40. The ordering of the filtering and cooling may be interchanged. Once the gas has preformed work in the refrigerator 34, it is returned to the pump by a return line 42 connected to the inlet port 14.

During operation of the refrigeration system, a considerable amount of heat is generated by the pump. To prolong the life of the pump, I have determined that the most effective way to cool the pump is to use the oil in the sump 30 for cooling. This is accomplished by feeding oil from the sump 30 through an external heat exchanger 44 to a heat exchange jacket 46 in thermal communication with the container 28. Preferably, the flow rate of the oil through the external heat exchanger 44 is controlled by a pressure differential (discussed below) across an oil injection orifice 50 to eliminate the need for a separate pump. The external heat exchanger 44 cools the oil to ambient temperature before flowing to the oil jacket 46. The cooled oil in the oil jacket 46 uniformly cools the pump 10 by absorbing heat transferred to the housing 28.

From the jacket 46, oil is pumped through a second external heat exchanger 48 where it is again cooled to ambient temperature. This cooled oil is fed to the return line 42 through an orifice 50 where it is recycled. As before, oil is pumped through the second exchanger 48 by a pressure differential at each end of the second exchanger 48 to avoid the use of a seperate pump. The pressure differential across both the heat exchange jacket 46 and the second external heat exchanger 48 is created when the mixture in the return line 42 is drawn into the suction chamber 16 compressed and exhausted into the housing. Thus, a pressure differential is realized between the housing 28 containing pressurized gas and the return line regulated by the suction of the pump.

It has therefore been shown how a compressor pump used in cryogenic refrigeration is cooled by using oil from the oil sump within the pump. In this construction, the pump is cooled by an oil jacket which receives oil from the sump after it has been cooled by an external heat exchanger. Cool oil is returned from the jacket to the pump for recycling by cooling the oil with a second heat exchanger. The system described eliminates pumps used in conventional systems to pump a secondary coolant, thereby reducing the overall packaging space. Similary, fins and fans used in conventional air cooling systems can be eliminated. Thus, a more efficient means for cooling the compressor is achieved without sacrificing space and supplying a secondary cooling source such as water for cooling the pump.

While this invention has been particularly shown and described with reference to preferred embodiments thereof, it will be understood by those skilled in the art that various changes in form and details may be made without departing from the spirit and scope of the invention as defined in the appended claims. For example, gases other than helium may be used. Also, oil filtered by the seperator and absorber may be recycled back to the pump. Further, a pressure valve may be used between the feed line and the return line to regulate the pressure of the system.

I claim:

1. A cryogenic refrigeration system having an oil cooled compressor for compressing helium gas comprising:

(a) an oil sump located within the compressor;
(b) a heat exchanger for cooling oil in the sump;
(c) a heat exchange jacket surrounding the compressor for receiving oil cooled by the heat exchanger to cool the compressor;
(d) means for pumping the oil through the heat exchanger and the heat exchange jacket; and
(e) means for recycling the oil from the heat exchange jacket to the oil sump.

2. A cryogenic refrigeration system having an oil cooled compressor for compressing helium gas as claimed in claim 1 wherein pressure developed by the compressor provides the means for pumping oil.

3. A cryogenic refrigeration system having an oil cooled compressor for compressing helium gas as claimed in claim 1 further comprising a second heat exchanger for cooling oil recycled from the heat exchange jacket.

4. A cryogenic refrigeration system having an oil cooled compressor for compressing helium gas as claimed in claim 1 wherein the exchangers are external to the compressor.

5. A cryogenic refrigeration system having an oil cooled compressor for compressing helium gas as claimed in claim 1 further comprising a filter means for filtering oil from helium gas before using the gas to perform work.

6. A cryogenic refrigeration system having an oil cooled compressor for compressing helium gas as claimed in claim 1, further comprising a second heat exchanger for cooling the compressed helium gas.

7. An oil cooled compressor pump for compressing gas comprising:

(a) an oil sump located within the compressor;
(b) a first external heat exchanger for cooling oil in the sump;
(c) a heat exchange jacket surrounding the pump for receiving oil cooled by the first heat exchanger to cool the compressor; and,
(d) means for pumping the oil through the heat exchanger and the heat exchange jacket.

8. An oil cooled compressor pump for compressing gas as claimed in claim 7 further comprising means for recycling the oil from the heat exchanger jacket to the oil sump.

9. An oil cooled compressor pump for compressing gas as claimed in claim 7, further comprising a second heat exchanger for cooling oil in the jacket before it is recycled.

10. An oil cooled compressor pump for compressing gas as claimed in claim 7, further comprising a means for filtering oil from the helium gas.

11. An oil cooled compressor pump for compressing gas comprising as claimed in claim 7, wherein the compressor pump is used in a cryogenic refrigeration system.

12. An oil cooled compressor pump for compressing gas as claimed in claim 7, further comprising a third heat exchanger for cooling the compressed gas.

13. A method for oil cooling a compressor for compressing helium gas in a cryogenic refrigerator system comprising the steps of:

(a) cooling oil from an oil sump of the compressor by pumping the oil through a heat exchanger;
(b) pumping the oil cooled by the heat exchanger to a heat exchange jacket surrounding the compressor; and,
(c) recycling the oil from the heat exchange jacket to the oil sump of the compressor.

14. A method for oil cooling a compressor for compressing helium gas in a cryogenic refrigerator system as claimed in claim 13, further comprising the step of using pressure developed by the compressor to pump the oil through the heat exchanger and the heat exchange jacket.

15. A method for oil cooling a compressor for compressing helium gas in a cryogenic refrigerator system as claimed in claim 13, further comprising the steps of cooling the oil in the heat exchange jacket by pumping the oil through a second heat exchanger before recycling the oil to the oil sump.

16. A method for oil cooling a compressor for compressing helium gas in a cryogenic refrigerator system as claimed in claim 13, further comprising the step of filtering oil from the gas before it is used in a cryogenic refrigerator.

17. A method for oil cooling a compressor for compressing helium gas in a cryogenic refrigerator system as claimed in claim 13, further comprising the step of cooling the compressed helium gas.

18. A method for cooling a compressor pump with oil from the pump's oil sump, comprising the steps of:

(a) cooling oil from the oil sump by passing the oil through a heat exchanger;
(b) pumping the oil cooled by the heat exchanger to a heat exchange jacket surrounding the compressor; and
(c) recycling the oil in the heat exchange jacket to the oil sump of the compressor.

19. A method for cooling a compressor pump with oil from the pump's oil sump as claimed in claim 18, further comprising the step of cooling the oil in the heat exchange jacket by passing the oil through a second heat exchanger before recycling the oil to the oil sump.

20. A method for cooling a compressor pump with oil from the pump's oil sump as claimed in claim 18, further comprising the step of using pressure developed by the compressor to pump the oil through the heat exchangers.

* * * * *